US007460092B2

(12) United States Patent
Choi et al.

(10) Patent No.: US 7,460,092 B2
(45) Date of Patent: Dec. 2, 2008

(54) ORGANIC ELECTROLUMINESCENT DISPLAY AND DRIVING METHOD THEREOF

(75) Inventors: Wong-Sik Choi, Suwon-si (KR); Sung-Chon Park, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 614 days.

(21) Appl. No.: 10/992,765

(22) Filed: Nov. 22, 2004

(65) Prior Publication Data

US 2005/0140606 A1 Jun. 30, 2005

(30) Foreign Application Priority Data

Nov. 27, 2003 (KR) ..... 10-2003-0085123

(51) Int. Cl.
*G09G 3/30* (2006.01)

(52) U.S. Cl. ..... 345/76; 345/77

(58) Field of Classification Search ..... 345/76–82
See application file for complete search history.

(56) References Cited

U.S. PATENT DOCUMENTS 6,376,994 B1 * 4/2002 Ochi et al. ..... 315/169.1
7,233,302 B2 * 6/2007 Ishizuka ..... 345/77

FOREIGN PATENT DOCUMENTS

KR 10-2002-0037866 5/2002
KR 10-2002-0066209 8/2002

* cited by examiner

*Primary Examiner*—Duc Q Dinh
(74) *Attorney, Agent, or Firm*—H.C. Park & Associates, PLC

(57) ABSTRACT

An organic electroluminescent display and a driving method thereof are provided, in which the temperature of a panel may be sensed, a power supply voltage corresponding to the sensed temperature may be generated and supplied to a driving transistor. The present invention may provide constant power consumption and brightness even at high temperature by supplying an appropriate power supply voltage that corresponds to the temperature.

18 Claims, 4 Drawing Sheets

ORGANIC ELECTROLUMINESCENT DISPLAY AND DRIVING METHOD THEREOF

CROSS REFERENCE TO RELATED APPLICATION

This application claims priority to and the benefit of Korean Patent Application No. 2003-85123 filed on Nov. 27, 2003 in the Korean Intellectual Property Office, which is incorporated herein by reference in its entirety.

BACKGROUND OF THE INVENTION

1. Field of the Invention

The present invention relates to an organic electroluminescent (EL) display and a driving method thereof.

2. Description of the Related Art

An organic electroluminescent display electrically excites, for example, a phosphorous organic compound to emit light, and drives N×M organic emitting cells to display images. As shown in FIG. 1, the organic emitting cell may include an anode (for example, made of ITO), an organic thin film, and a cathode layer (for example, made of metal). The organic thin film may have a multi-layer structure including an emitting layer (EML), an electron transport layer (ETL), and a hole transport layer (HTL) for maintaining balance between electrons and holes and for improving emitting efficiencies. It may also include an electron injecting layer (EIL) and a hole injecting layer (HIL).

Methods for driving the organic emitting cells may include a passive matrix method, and an active matrix method using thin film transistors (TFTs) or MOSFETs. The passive matrix method includes cathodes and anodes that cross each other, and drives by selecting lines. The active matrix method couples a TFT and a capacitor to each indium tin oxide (ITO) pixel electrode to thereby maintain the voltage by capacitance.

FIG. 2 shows a pixel circuit for driving an organic electroluminescent element of an organic electroluminescent device using TFTs for one of the N×M pixels.

As shown in FIG. 2, a current driven transistor Mb is coupled to the organic electroluminescent element of the organic electroluminescent device, and supplies a current for light emission. The amount of current of the current driven transistor Mb is controlled by a data voltage applied through a switching transistor Ma. In this instance, a capacitor C for maintaining the applied voltage may be coupled between a source and a gate of the transistor Mb. A gate of the transistor Ma may be coupled to the $n^{th}$ scan line Scan[n], and a source thereof may be coupled to the data line Data[m].

As to the operation of the above-described pixel circuit, when the transistor Ma is turned on (because of a scan signal applied to the gate of the switching transistor Ma) a data voltage $V_{DATA}$ is applied to the gate of the driving transistor Mb through the data line. Accordingly, a current correspondingly flows to the organic electroluminescent element through the transistor Mb to allow the organic electroluminescent element to emit light.

The current flowing to the organic electroluminescent element may be given by Equation 1:

$$I_{OELD} = \frac{\beta}{2}(V_{GS} - V_{TH})^2 = \frac{\beta}{2}(V_{DD} - V_{DATA} - V_{TH})^2, \quad \text{Equation 1}$$

in which $I_{OELD}$ is a current flowing to the organic electroluminescent element, $V_{GS}$ is a voltage between the source and the gate of the transistor Mb, $V_{TH}$ is a threshold voltage of the transistor Mb, $V_{DD}$ is a power supply voltage, $V_{DATA}$ is a data voltage, and β is a constant. β may be found according to Equation 2.

$$\beta = \mu Cox\left(\frac{W}{L}\right), \quad \text{Equation 2}$$

in which μ is the mobility of electrons or holes, Cox is capacitance of an oxide film, W is a channel width, and L is a channel length.

As given in Equation 1, the current corresponding to the applied data voltage $V_{DATA}$ may be supplied to the organic electroluminescent element of the organic electroluminescent device, and the organic electroluminescent element may emit light in response to the supplied current in the pixel circuit shown in FIG. 2. In such a case, the applied data voltage $V_{DATA}$ may have multi-level values within a predetermined range in order to represent gray scales.

However, the conventional electroluminescent display increases power consumption and brightness in high temperature operation because higher temperature leads to higher mobility of the electrons or holes, thereby increasing the value of β. Resultantly, the current flowing to the organic electroluminescent element may increase as can be seen by examination of Equation 2. More current can increase resistance-induced heat, which (in turn) can lead to yet higher current levels. This unwanted feedback mechanism is known as thermal runaway.

SUMMARY OF THE INVENTION

The present invention may advantageously provide an organic electroluminescent display that allows constant power consumption and brightness at high temperatures. The present invention may also provide a driving method for such a display.

In one aspect of the present invention, an organic electroluminescent display may include a panel including a plurality of data lines, a plurality of scan lines crossing the data lines, and a plurality of pixel circuits being formed at areas defined by the data lines and the scan lines. The pixel circuits may include organic electroluminescent elements. The display may also include a scan driver for applying scan signals to the scan lines and a data driver for applying data voltages corresponding to gray data to the data lines. The display may additionally include a temperature sensor for sensing the temperature of the panel and a power supply voltage generator for generating a power supply voltage corresponding to the temperature sensed by the temperature sensor. The power supply may supply the voltage to the pixel circuit of the panel.

The present invention may also provide a method for driving an organic electroluminescent display. This display may include a driving transistor for outputting a current to corresponding to a first power supply voltage applied to a first terminal and a data voltage applied to a control terminal to a second terminal. The display may also include an organic electroluminescent element for emitting light corresponding to the output current of the driving transistor. The method may also include sensing the temperature of the organic electroluminescent display and supplying a voltage corresponding to the temperature previously is sensed.

DETAILED DESCRIPTION OF THE PREFERRED EMBODIMENTS

In the following detailed description, only preferred embodiments of the invention have been shown and described, to illustrate the invention. As will be realized, the invention may be modified in various respects without departing from the invention. Accordingly, the drawings and description are to be regarded as illustrative in nature, and not restrictive.

An electroluminescent display and driving method thereof will be described in detail with reference to drawings.

Figure 3:
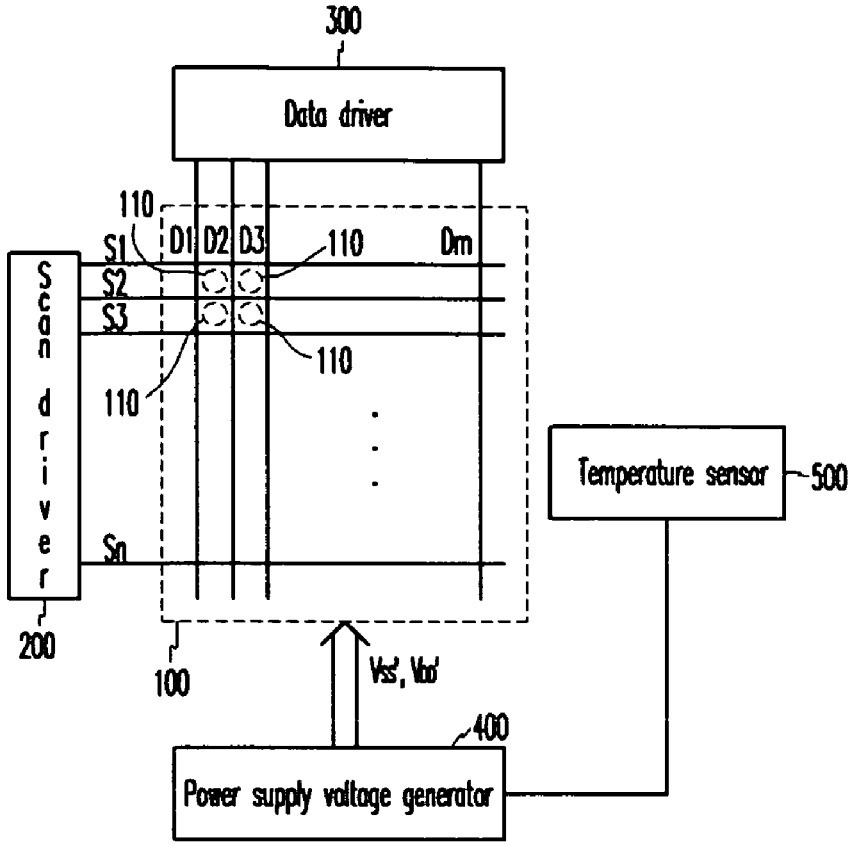
FIG. 3 shows an organic electroluminescent display according to an exemplary embodiment of the present invention.

FIG. 3 shows an organic electroluminescent display according to an exemplary embodiment of the present invention.

As shown, the organic electroluminescent display may include an organic electroluminescent panel 100, a scan driver 200, a data driver 300, a power supply voltage generator 400, and a temperature sensor 500.

Figure 1:
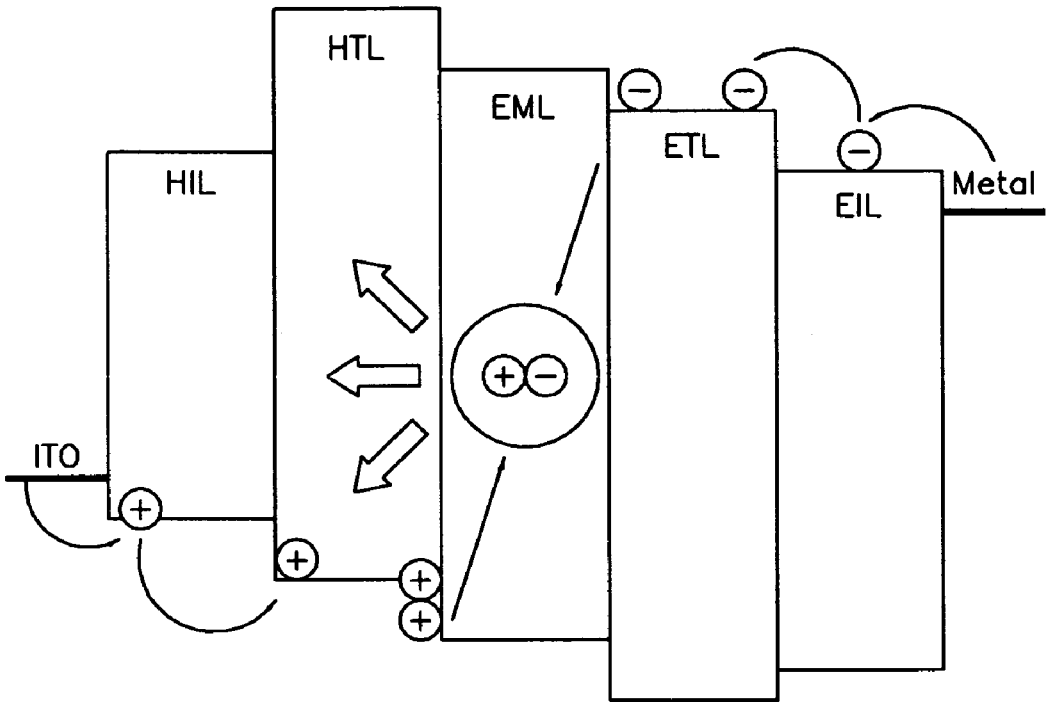
FIG.1(Prior Art)
FIG. 1 shows a general organic electroluminescent element.
Figure 2:
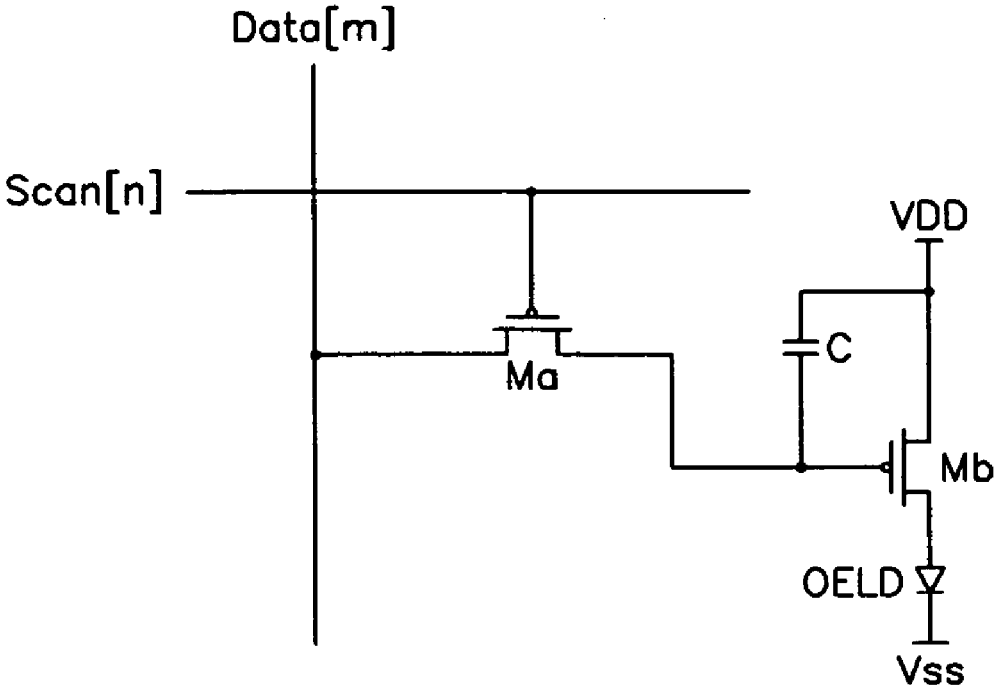
FIG.2 (Prior Art)
FIG. 2 shows a pixel circuit for driving an organic electroluminescent element.

The organic electroluminescent panel 100 may include a plurality of data lines D1 to Dm for transmitting data voltages for displaying video signals, a plurality of scan lines S1 to Sn for transmitting scan signals, and a plurality of pixel circuits 110 respectively formed at a plurality of pixels defined by the data lines and the scan lines. In this instance, the pixel circuit shown in FIG. 2 or other similarly improved pixel circuits can be used for the pixel circuit 110. The pixel circuit 110 may include an organic electroluminescent element, a driving transistor, a capacitor, and a switching transistor.

The data driver 300 may apply data voltages for displaying video signals to the data lines, and the scan driver 200 may sequentially apply scan signals to the scan lines.

The temperature sensor 500 for sensing the temperature of the organic electroluminescent panel 100 or the temperature of its surrounding environment (for example, within a casing), is attached to a flexible printed circuit (FPC) or printed circuit board (PCB) driving circuit attached to the panel 100. This temperature sensor may measure the temperature of the organic electroluminescent display panel 100.

The power supply voltage generator 400 generates power supply voltages VDD and VSS corresponding to the temperature sensed by the temperature sensor 500. In this instance, the power supply voltage VDD is a power supply voltage coupled to a source of the driving transistor of the pixel circuit. Similarly, the power supply voltage VSS is a power supply voltage coupled to a drain of the driving transistor through the organic electroluminescent element.

Figure 4:
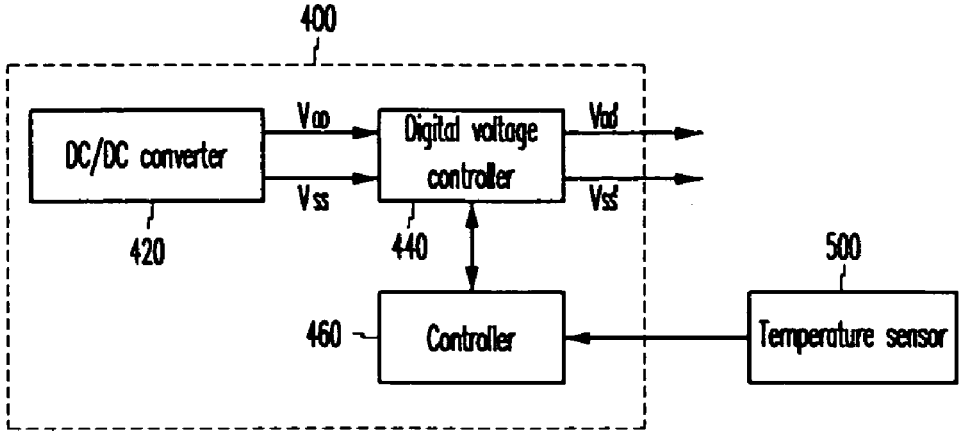
FIG. 4 shows a power supply voltage generator according to an exemplary embodiment of the present invention.

FIG. 4 shows a further detailed diagram of a power supply voltage generator 400 as shown in FIG. 3.

As shown in FIG. 4, the power supply voltage generator 400 may include a DC/DC converter 420, a digital voltage controller 440, and a controller 460.

The DC/DC converter 420 may receive a DC power supply voltage. This power supply voltage may, for example, be supplied by a battery. The DC/DC converter 420 may then convert the DC power supply voltage into a DC driving voltage for driving the organic electroluminescent pixel circuit. It then provides this DC driving voltage as an output. In this instance, the power supply voltage VDD (which may be coupled to the source of the driving transistor) and the power supply voltage VSS (which may be coupled to the cathode of the organic electroluminescent element) may be exemplary driving power supply voltages for the pixel circuits in the exemplified embodiment. Other power supply voltages can additionally be generated.

The digital voltage controller 440 receives output voltages from the DC/DC converter 420, controls voltages input by control of the controller 460, and supplies the controlled power supply voltages VDD' and VSS' to the organic electroluminescent panel 100.

The controller 460 may be realized by a microcomputer or a field programmable gate array (FPGA), and may control the digital voltage controller 440 so that the power supply voltage VDD and VSS may be supplied to the organic electroluminescent panel. VDD and VSS may be based on the predefined voltages VDD' and VSS' but modified when the temperature of the organic electroluminescent panel increases beyond a predetermined temperature. That is, the controller 400 may control the digital voltage controller 440 to output the controlled voltages VDD' and VSS' when the temperature sensed by the temperature sensor 500 exceeds the predetermined temperature.

In this example, to prevent an increase of the current because of an increase of mobility of electrons or holes of the driving transistors when the temperature of the organic electroluminescent panel increases, the power supply voltage VDD may be reduced to the predetermined voltage VDD' that corresponds to compensate for the increase of the temperature. This appropriate voltage may be calculated by reference to Equation 1. The current increase caused by the higher mobility can be offset by reducing the power supply voltage VDD when the the panel becomes hotter than a predetermined temperature. Accordingly, the organic electroluminescent element can be driven with a stable current. Hence, it follows that the increase of power consumption, and increased brightness caused by the increased temperature can be controlled.

While this invention has been described in connection with what is presently considered to be a practical and preferred embodiment, it is to be understood that the invention is not limited to the disclosed embodiments, but includes various modifications and equivalent arrangements.

For example, the exemplary embodiment of the present invention adjusts the voltage to a predetermined voltage when the temperature of an organic electroluminescent display exceeds a predetermined temperature. Also, the present invention includes slightly more sophisticated techniques such as having a plurality of predetermined driving voltages each corresponding to various temperature ranges.

A power supply voltage generator according to an exemplary embodiment has been illustrated in FIG. 4, but it can also be alternatively configured through other circuit designs.

As described, constant power consumption and brightness may be provided at a high temperature by sensing the temperature of the panel and supplying a power supply voltage that compensates for effects of the sensed temperature on the organic electroluminescent panel.

What is claimed is:

1. An organic electroluminescent display, comprising:

a panel including a plurality of data lines, a plurality of scan lines crossing the data lines, and a plurality of pixel circuits that are located at areas approximately corresponding to places where the data lines and scan lines cross and that have organic electroluminescent elements;

a scan driver for applying scan signals to the scan lines;

a data driver for applying data voltages corresponding to gray data to the data lines;

a temperature sensor for sensing the temperature of the panel; and a power supply voltage generator for generating a power supply voltage corresponding to the temperature sensed by the temperature sensor, and supplying it to the pixel circuit of the panel, wherein the power supply voltage generator comprises:

a DC/DC converter for receiving a DC power supply voltage, converting it into a first power supply voltage for driving the pixel circuit, and outputting the first power supply voltage;

a voltage controller for receiving the first power supply voltage output by the DC/DC converter, and converting it into a second power supply voltage to be supplied to the pixel circuit; and a controller for controlling the voltage controller to output the second power supply voltage according to the temperature of the panel.

2. The organic electroluminescent display of claim 1, wherein the pixel circuit comprises a driving transistor for supplying the current corresponding to the data voltage to the organic electroluminescent element, and wherein the power supply voltage is a power supply voltage of the driving transistor.

3. The organic electroluminescent display of claim 2, wherein the power supply voltage is a voltage coupled to a source of the driving transistor.

4. The organic electroluminescent display of claim 3, wherein the power supply voltage is inversely related to the temperature of the panel.

5. The organic electroluminescent display of claim 1, wherein the power supply voltage generator controls the voltage controller so that the predefined second voltage drives when the temperature of the panel exceeds a predetermined temperature.

6. The organic electroluminescent display of claim 1, wherein the power supply voltage generator for generating a power supply voltage corresponding to the temperature supplies a predetermined voltage that corresponds to a temperature range, within which the temperature lies.

7. The organic electroluminescent display of claim 1, wherein the power supply voltage generator for generating a power supply voltage corresponding to the temperature supplies a voltage that maintains power consumption of the display.

8. The organic electroluminescent display of claim 1, wherein the power supply voltage generator for generating a power supply voltage corresponding to the temperature supplies a voltage that maintains brightness of the display.

9. The organic electroluminescent display of claim 1, wherein the temperature sensor senses an ambient temperature of an environment surrounding the panel.

10. A method for driving an organic electroluminescent display, comprising:

sensing a temperature of the organic electroluminescent display including a driving transistor for outputting a current corresponding to a first power supply voltage applied to a first terminal and a data voltage applied to a second terminal, and an organic electroluminescent element for emitting light corresponding to the output current of the driving transistor; and supplying a voltage corresponding to the temperature as a first power supply voltage, wherein supplying a voltage comprises:

receiving a DC power supply voltage;

converting the DC power supply voltage into a first power supply voltage and a second power supply voltage;

providing the first power supply voltage and second power supply voltage as selectable outputs; and selecting either the first power supply voltage or the second power supply voltage based on the temperature.

11. The method of claim 10, wherein supplying a voltage corresponding to the temperature as a first power supply voltage comprises:

determining whether the temperature is greater than a predetermined temperature; and supplying a power supply voltage which is lower than a power supply voltage supplied at below the predetermined temperature as the first power supply voltage when the temperature exceeds the predetermined temperature.

12. The method of claim 10, wherein the first power supply voltage is a voltage coupled to a source of the driving transistor.

13. The method of claim 10, wherein supplying a power supply voltage comprises supplying a power supply voltage that is inversely related to the temperature.

14. The method of claim 10, wherein selecting either the first power supply voltage or the second power supply voltage based on the temperature comprises selecting the first power supply voltage when the temperature is below a predetermined temperature and selecting the second power supply voltage when the temperature is above the predetermined temperature.

15. The method of claim 10, wherein selecting either the first power supply voltage or the second power supply voltage based on the temperature comprises selecting the first power supply voltage when the temperature is within a first predetermined temperature range and selecting the second power supply voltage when the temperature is within a second predetermined temperature range.

16. The method of claim 10, wherein supplying a voltage corresponding to the temperature as a first power supply voltage comprises supplying a voltage that maintains power consumption of the display.

17. The method of claim 10, wherein supplying a voltage corresponding to the temperature as a first power supply voltage comprises supplying a voltage that maintains brightness of the display.

18. The method of claim 10, wherein sensing the temperature of the organic electroluminescent display comprises sensing the air temperature of the air surrounding a panel of the display.

* * * * *